US005281161A

United States Patent [19]

Kanai

[11] Patent Number: 5,281,161

[45] Date of Patent: Jan. 25, 1994

[54] ELECTRICAL CONNECTOR WITH MODULE HOLDER

[75] Inventor: Hirosumi Kanai, Kawasaki, Japan

[73] Assignee: The Whitaker Corporation, Wilmington, Del.

[21] Appl. No.: 932,828

[22] Filed: Aug. 20, 1992

[30] Foreign Application Priority Data

Oct. 17, 1991 [JP] Japan ..... 3-092698[U]
May 13, 1992 [JP] Japan ..... 4-038629[U]

[51] Int. Cl.[5] ..... H01R 13/627
[52] U.S. Cl. ..... 439/357; 439/701
[58] Field of Search ..... 439/78, 345, 350, 351, 439/355, 357, 358, 372, 677, 680, 686, 701

[56] References Cited

U.S. PATENT DOCUMENTS 4,335,929 6/1982 Abernethy ..... 439/358
4,602,839 7/1986 Winger ..... 439/358
4,964,817 10/1990 Kanai ..... 439/701

*Primary Examiner*—Larry I. Schwartz
*Assistant Examiner*—Khiem Nguyen
*Attorney, Agent, or Firm*—Timothy J. Aberle

[57] ABSTRACT

An electrical connector (60) includes a holder (40) for detachably holding modules (50*a*, 50*b*) fitted therein transversely to the axis of engagement with the holder/-module subassembly pluggable into the connector (60) along such axis. Embodiments include holders (40) that latch through latching arms (48*a*, 48*b*) into connectors (60), holders (100) that are frictionally held interiorly within connectors (130) and holders (200) that have short latches (240) that latch to the connector (230) and modules (220*a*, 220*b*); all of the embodiments incorporating single row connector modules (50*a*, 50*b*–120*a*, 120*b*–220*a*, 220*b*) pluggable into connectors (60–130–230) holders (40–100–240), respectively.

4 Claims, 4 Drawing Sheets

ELECTRICAL CONNECTOR WITH MODULE HOLDER

This invention relates to an electrical connector having a holder that fits inside a connector housing to retain modules carrying contact terminated wires.

BACKGROUND OF THE INVENTION

To facilitate high volume production in harness making for connectors utilized with respect to consumer electronics it has proven to be advantageous to provide connectors having a single row of terminated contacts, such construction facilitating mass termination, mass loading and handling.

Japanese laid open UM Patent Application No. 106,688/'90, illustrated in part in FIG. 5 of this application shows an example of such prior art practice. One problem encountered with the use of connectors as described in the forgoing mentioned Japanese UM Patent Application is that loads applied to the connectors through wires caused by a variety of uses can result in the connectors becoming disengaged and being displaced from engagement with mating connectors on printed circuit boards and the like. Another problem has to do with the displacement of holders carrying modules with respect to the contacts of a printed circuit or the like.

Accordingly, an object of the present invention is to provide an improvement with respect to the prior art that features a connector housing that includes a holder carrying contact modules with surfaces arranged to latch and hold the modules to the holder and the holder to the housing in such a way as to preclude or minimize accidental displacement of elements to result in failure of connection. It is a further object to provide a single row connector module adapted to be fitted within a holder in turn plugged into a connector housing in such a way as to hold the various elements reliably together.

SUMMARY OF THE INVENTION

The present invention achieves the forgoing objectives through the provision of a combination of plastic elements including a housing having walls and an internal cavity containing two rows of contacts, such contacts being joined to conductive traces of a printed circuit board as by solder or other means; the housing cavity having an axis of insertion to receive a subassembly comprised of a holder and a pair of single row contact modules preassembled and latched to the holder inserted into the housing cavity to be connected to the contacts therein. The holder in one embodiment includes guide surfaces on the exterior thereof that serve to guide the holder during insertion into the cavity of the housing of the connector with latch surfaces incorporated to receive the modules installed therein before insertion of the holder within the cavity of the connector in a sense laterally to such axis of insertion. The modules and holder include surfaces that engage mating surfaces of the connector housing to effect such guiding and further surfaces that engage latching surfaces and holding surfaces of the holder to hold the modules in place during insertion of the subassembly formed of the holder and modules within the housing of the connector. In one embodiment, the holder includes flexible and resilient latches that engage the end, outside of the housing of the connector to latch the holder and thus the modules to such connector. In another embodiment, the holder includes latch arms that can be deflected in two directions, one direction facilitating insertion along the given axis of the holder onto the housing of the connector and another axis perpendicular thereto allowing deflection of the arms in a sense to receive the modules transversely to such axis.

The modules contain contacts terminated to wires arranged in a single row on centers to mate with the contacts of the housing and the holder includes an interior membrane or wall that divides and isolates the modules from each other with a plate that has apertures to receive the contacts of the housing therethrough and then being connected with the contacts of the modules.

The holder of the invention thus is adapted to receive the modules inserted and latched therein from the sides with the subassembly formed thereby being inserted into the housing of the connector along the axis of engagement of the contacts.

DETAILED DESCRIPTION OF THE INVENTION

Figure 5:
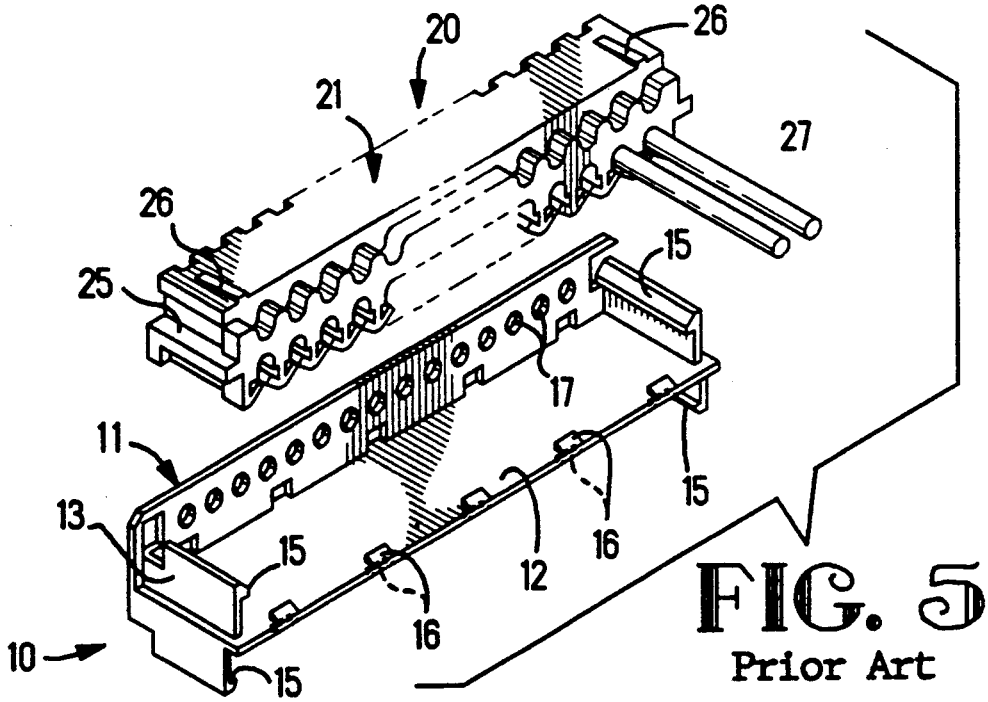
FIG. 5 Prior Art
FIG. 5 is a perspective exploded view viewed from the rear of an assembly of a prior art module and holder.

Referring first to FIG. 5 and the prior art representation of a holder/module combination, element 10 refers to a holder and element 20 to one of two modules, utilized with such holder, the other module not shown but similar to module 20 and fitting into the holder 10 parallel to the module 20 shown. The modules and holder are typically molded of an engineering plastic that has suitable dielectric qualities and flexibility to accommodate contacts inserted therein carrying wires with respect to the modules and latching elements with respect to both the modules and the holder. As can be seen in FIG. 5, holder 10 includes a wall 11 having apertures 17 to receive contacts inserted therethrough that fit within a module, not shown. A further wall extends oppositely from that shown in FIG. 5 to accommodate the alternative module 20 that fits on the bottom of the holder. Holder 10 further includes a dividing and isolating plate 12 that is essentially disposed transversely to wall 11 and is joined at the ends by portions 13 that extend top and bottom of plate 12 and contain on the ends thereof latches 15 that serve to hold a module 20 in place within the holder. Projections 16 cooperate with the rear face of the modules to hold the modules against wall 11. Each module 20 includes a forward face 21 which abuts wall 11 and further includes surfaces 25 at the ends that cooperate with the latches 15 on end portions 13. Projections 26 shown on the module 20 are utilized to preclude an improper insertion of module 20 with respect to holder 10. In use, following termination of contacts (not shown) in modules 20 to wires 27, the modules 20 are inserted within the top and bottom portions of holder 10 and latched thereto by latches 15. The subassembly thus formed by holder 10 and two modules 20 can then be plugged onto a printed circuit board with posts therefrom entering the apertures 17 and the contacts within modules 20 and aligned therewith, such contacts typically being receptacles terminated to wires 27 and held within modules 20.

Figure 1:
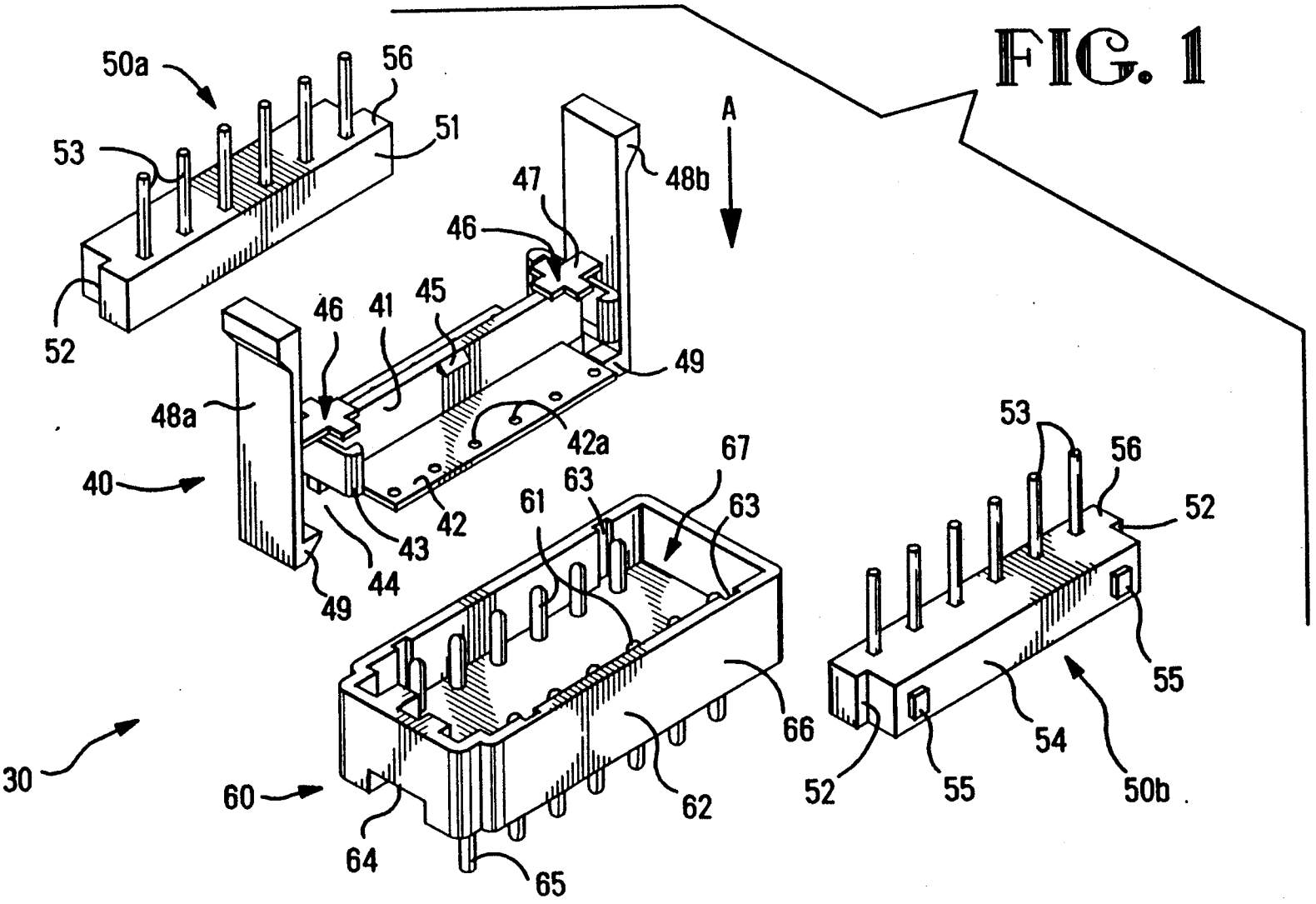
FIG. 1 is a perspective exploded view showing various elements of the combination of connector, holder and modules prior to assembly.

Referring now to FIG. 1 and a preferred embodiment of the invention, the various elements including holder 40, modules 50*a* and 50*b* and a connector 60 are shown disassembled. The holder 40 may be seen to include an upstanding dividing wall 41 extending between the ends thereof with an integrally formed plate 42 extending out from the bottom of such wall, a corresponding plate 42 extending opposite to that shown. The plates 42 include apertures 42*a* that receive the contacts 61 of the connector 60. As can be seen a pair of latches 43 extend outwardly from wall 41 in a sense transverse to the axis of insertion shown by the arrow A in FIG. 1. These latches are flexible and include interior surfaces that engage portions of the modules in a manner to be described, a relief 44 being provided freeing the latches for movement. Also included in the upper middle portion of wall 41 is a projection 45 that includes a surface that engages the top surface of a module, there being a similar projection on the opposite side of the wall not shown. At each end at the top of wall 41 are elements 46 that extend thereover and cover the top surface ends of the modules. Extending from elements 46 are hinge sections 47 and attached thereto are latch arms 48*a* and 48*b* that end in projections 49 that provide an engagement with the surfaces 64 of the connector 60, shown in FIG. 1 for the left hand latching arm 48*a*.

Each of the modules 50*a* and 50*b* include a housing 51 containing a surface 52 at each end and wires 53 that terminate to contacts (not shown) secured in the housing. Each of the modules includes an upper surface 56 and side projections 55. Typically the contacts are terminated to wires 53 and inserted within the module housings 51 and held therein by latches or other means. The invention also contemplates a use of modules of a configuration that facilitate a mass termination of preloaded contacts in a well known manner.

The connector 60 of the invention includes a housing 62 with walls 66 that define an internal cavity 67. The walls include slots 63 forming keyways that are engaged by projections 55, shown in the right hand most module 50*b* in FIG. 1 to facilitate an alignment in positioning of the modules and thus of a subassembly comprised of the two modules 50*a* and 50*b* and holder 40. As mentioned, surfaces adjacent the bottom of the connector receive the surfaces 49 of the latch arms 48 that snap onto surfaces 64 to hold the holder to the housing.

In practice, following termination of contacts within the modules 50*a* and 50*b* to wires 53, the modules are pushed in a sense laterally to the axis of insertion A into the holder 40. As this occurs the latches 43 snap over the projecting ends onto surfaces 52 of the modules with the plate 42 receiving the end faces of the modules and the upper surfaces 56 fitting under the projections 45 and the elements 46 to center and position the modules precisely with respect to the holders 40. The apertures 42*a* are in accordance with the invention aligned with apertures not shown in the bottom face of the modules through which the contacts 61 fit to interconnect the module contacts to contacts 61. In practice each contact 61 extends down below the top surface of housing 62 in the manner shown in FIG. 4 with respect to an alternative embodiment and are soldered or otherwise joined to circuit traces on a board 250 shown in FIG. 4.

Figure 4:
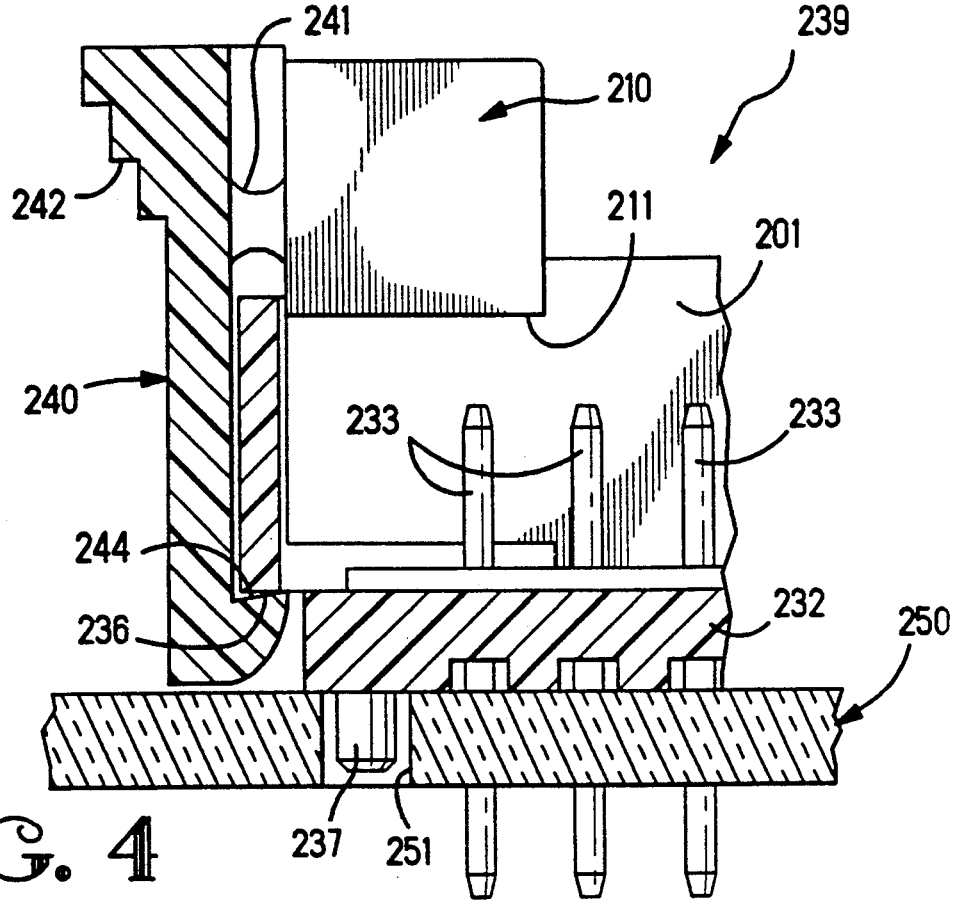
FIG. 4 is a partly sectioned end of the connector, holder and module embodiment shown in FIG. 3.

In practice, housings 62 of connector 60 may be fitted onto the printed circuit boards, posts 65 at opposite corners of housing 60 fitting in alignment apertures 251 with respect to the embodiment shown in FIG. 4 and with the posts thereafter soldered to the board. Following termination of the modules and insertion of the modules in holder 40 in the lateral sense as described with the modules latched to the holder and the holder 40 and modules 50*a*, 50*b* now a subassembly, the holder can then be plugged into housing 62, the subassembly fitting within cavity 67, projections 55 helping guide and align the subassembly until the latch arms 48*a* and 48*b* are deflected outwardly to snap onto surfaces 64 and latch the subassembly to the connector. At that point, sideways loads or end loads caused by stress on wires 53 are resisted by the engagement of the exterior surfaces of the holder and the modules with respect to the wall 66 of housing 60; and, axial loads, loads along the axis A, are resisted first by the surfaces 56 of the modules in engagement as described and then by the projections 49 of the latch arms 48*a* and 48*b* of the holder engaging surfaces 64. For removal, a deflection inwardly of the arms 48*a* and 48*b* will release the projections 49 and allow withdrawal of the subassembly from the connector 60 effecting a disconnect of the contacts. Elements 46 assist in maintaining modules 50*a*, 50*b* onto holder 40, provide push down areas for pushing the sub-assembly into connector 60 and provide mounting members for latch arms 48*a*, 48*b*.

Figure 2:
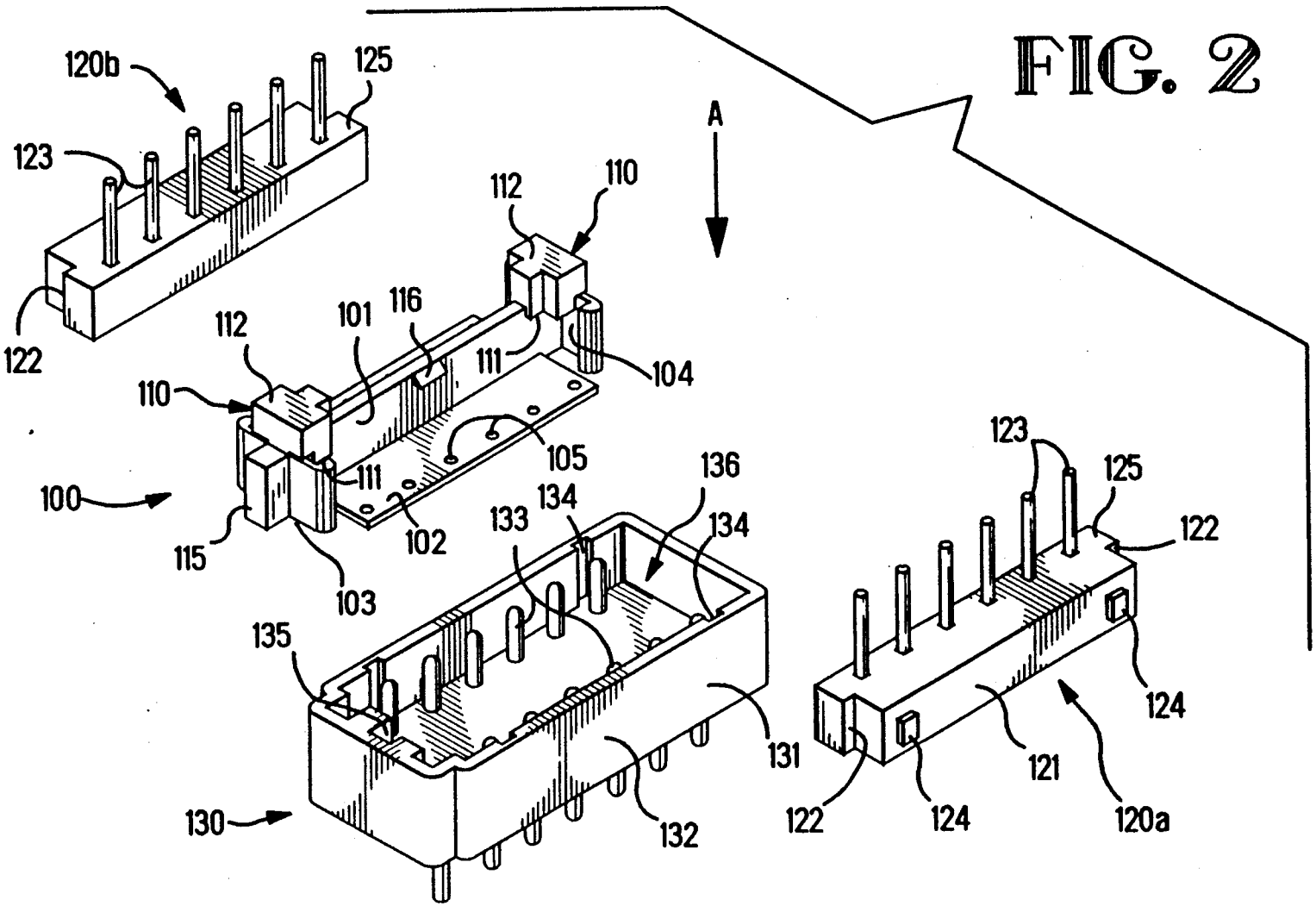
FIG. 2 is a perspective exploded view showing the combination of connector, holder and modules prior to assembly of another different embodiment.

Referring now to FIG. 2, a second embodiment of the invention is shown including a holder 100, modules 120*a* and 120*b* and a connector 130 including a housing 131. As before these various elements are molded of an engineering plastic having suitable dielectric and resilient qualities to perform the connector function desired. Holder 100 includes an isolating wall 101 similar to that previously described and integrally formed therefrom and extending laterally outwardly a bottom plate 102 apertured as at 105 to receive terminals 133 of connector 130. At each end of the holder are flexible arms 103 having latch surfaces 104 extending therefrom in the sense laterally to the axis A of insertion shown in the Figure. At the upper ends of holder 100 extending out of the ends of wall 101 are pushdown blocks 110 having upper exterior surfaces 112. A thin walled projection 115 is provided at the left end of holder 100 for purposes to be described. Also, projecting from each side of the upper center of wall 101 is a projection 116 having a surface that is adapted to engage the upper surface of a module in a matter to be described. To be noted with respect to holder 100 is the absence of latches that extend outwardly in the manner of the previous embodiment, the holder fitting entirely within the cavity of the connector housing.

The modules 102*a* and 120*b* each include plastic housing 121 having cavities (not shown) that receive contacts terminated to wires 123 in the manner illustrated with respect to wires 53 in the embodiment of FIG. 1. Additionally, housing 121 includes a relief at each end including a surface 122 and projections 124 extending outward from the sidewall of the module. The module 120*b* can be seen to have a similar configuration with both modules having an upper surface 125 that is engaged by, in the center thereof the undersurface of projection 116 and the undersurface 111 of blocks 110. The bottom surfaces of the modules fit against the upper surface of the plates 102 and the end surfaces 104 of latches 103 fit onto the relief surfaces 122 of the modules to latch the modules against isolating wall 101 with the remaining surfaces holding the modules against plates 102. In practice, following termination and insertion of contacts and wires within the modules, the modules are displaced laterally in against the holders with the various latching surfaces and holding surfaces cooperating to hold the modules to the holder to form a subassembly.

The connector 130 may be seen to have a housing 131 having walls 132 and defining an interior cavity 136. Walls 132 contain at the ends recesses 134 that cooperate with the projections 124 of modules 120*a* and 120*b* to align the modules and holder 100 with respect to housing 131 and connector 130. Contacts 133 can be seen to extend vertically, along the axis A and include portions projecting beneath the housing 131 that are terminated to traces on a printed circuit board in the manner previously described. At one end of housing 131 is a recess or relief 135 that receives projection 115 of the holder to polarize and align the holder with respect to the housing.

In practice, following insertion of the modules into the holder the subassembly thus formed is then plugged into the connector 130 fitting within cavity 136, the various projections and surfaces of the modules and holder resisting sideways displacement of the contacts, and the various surfaces beneath projections 116 and surfaces 111 operate to hold the modules and holder within the connector 130.

Figure 3:
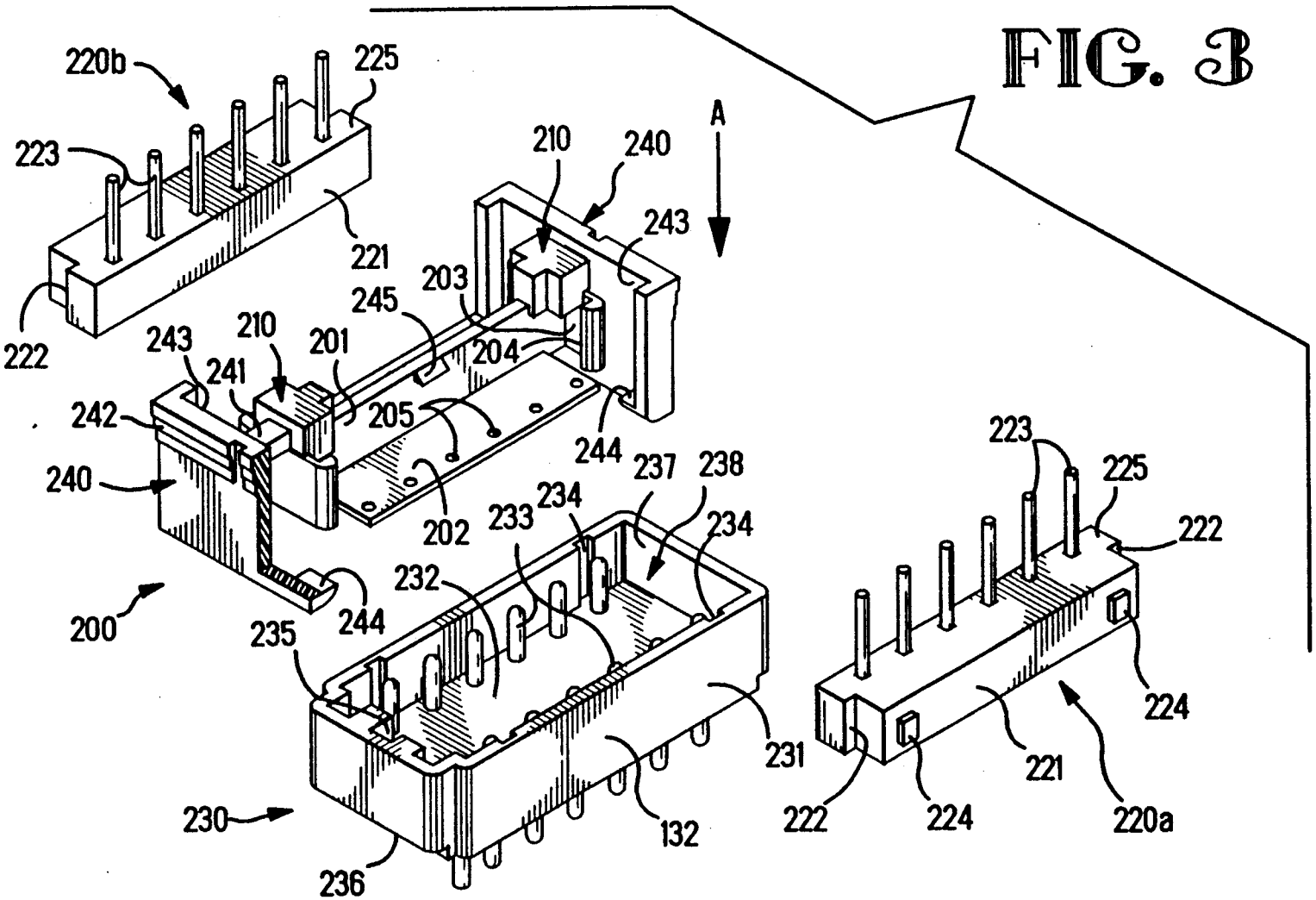
FIG. 3 is a perspective exploded view showing the combination of connector, holder and modules prior to assembly of a further embodiment.

Referring now to FIG. 3, yet a further alternative embodiment, is shown to include a holder 200, modules 220*a* and 220*b* and a connector 230. As can be seen in FIG. 3, the holder 200 includes an isolating central wall 201, a plate 202 and an opposite plate (not shown) extending perpendicularly from the bottom of wall 201. The plates 202 include apertures 205 that receive the contacts of the connector in a manner to be described. At the ends of wall 201 are resilient arms 203 that extend laterally with respect to the axis of insertion shown as arrow A in FIG. 3. Projections 204 of arms 203 include surfaces that engage the ends of the modules in a manner to be described.

At the upper ends of plate 201 are pushblocks 210 that have undersurfaces that receive the upper surfaces of the modules in a manner previously described and extending from the pushblocks 210 are resilient hinge portions 241 that carry projections in the form of a latch arm 240 that has a number of surfaces including stepped gripping surfaces 242 that facilitate a withdrawal of the holder and thus the modules from the connector 230 in a manner to be described. Surfaces 243 engage the ends of the modules and surfaces 244 engage the undersurfaces 236 of the modules. In accordance with this embodiment, the latch arms 240 are resiliently disposed to be deflected with respect to axis A thereby pivoting inwardly outwardly in a horizontal sense. Each of the modules 220*a* include a housing 221 containing cavities receiving contacts (not shown) connected to wires 223 in the manner described with respect to the previous embodiments. At the ends of the housings 221 are surfaces 222 that are engaged by the surfaces of projections 204 of arms 203. Projecting from the one side of housings 221 are projections 224 that cooperatively engage slots or grooves 234 in the connector in the manner to be described. The upper surfaces 225 of each module are positioned to be engaged by the bottom surfaces of the blocks 210 and by the bottom surface of a projection 245 located in the center, upper region of wall 201.

The connector 230 includes a housing 231 having walls 237 defining an interior cavity 238 in conjunction with a floor 232 also shown in FIG. 4. Contacts 233 extend vertically from the floor 232 and are engaged by the contacts of the modules at the upper end and are joined to circuit traces of a printed circuit board shown as 250 in FIG. 4. Toward the ends and interiorly disposed of the side walls of housing 231 are the slots 234 engaged by the projections 224 of the modules to align the subassembly formed of the modules and the holder. Additionally, there is a slot at one end, interiorly of housing 230, such slot shown as 235 that is analogous to the slot shown as 135 with respect to the embodiment of FIG. 2 to enable the housing 231 to be utilized with the embodiment of FIG. 2 as well as with the embodiment shown in FIG. 3 with respect to holder 200. At the outside ends of housing 230 are reliefs including surfaces 236 that are engaged by surfaces 244 of holder 200. In practice modules 220*a* and 220*b* are installed laterally in holder 200 with the various surfaces and latches holding the modules in place therein nested against wall 201 and against the upper surface of plate 202. As this is done the latches 203 operate so that the surfaces of projections 204 engage surfaces 222 and with the upper surfaces 225 fitting underneath the blocks 210 and projections 245. Thereafter by deflecting the latching arms 240 in a vertical sense the holder and subassembly containing the modules may be plugged onto connector 230 with the surfaces 244 engaging surfaces 236 to hold the subassembly in place thereon. Blocks 210 have the same features as elements 46 of FIG. 1.

Having now defined the invention with respect to several embodiments, claims now appended intended to define what is inventive.

I claim:

1. An electrical connector assembly comprising:

a dielectric holder having a wall plate and a bottom plate at the bottom of the wall plate and extending at a right angle with respect thereto, spaced openings in the bottom plate;

connector modules having electrical contacts secured therein;

latch members at the ends of the wall plate latchably securing the connector modules to said holder on each side of the wall plate and against the bottom plate with contacts in the connector modules in alignment with the spaced openings;

projections having an uppermost edge, said edge being disposed adjacent the upper end of the wall plate engaging the connector modules;

an electrical connector including a dielectric housing having walls defining a cavity containing electrical contact members including first contact sections for electrical connection with electrical contacts through the openings in the bottom plate upon positioning the holder and connector modules thereon within said cavity and second contact sections for electrical connection to conductive traces on a circuit board; and members located at the upper ends of said wall plate engaging the upper surfaces of the connector modules, said members having a generally flat top surface which is located above said projections uppermost edge in a direction away from said bottom plate.

2. An electrical connector assembly as claimed in claim 1, wherein other latch members are mounted onto said wall plate for engagement with said connector.

3. An electrical connector assembly as claimed in claim 2, wherein said other latch members are mounted onto said members.

4. An electrical connector assembly as claimed in claim 1, wherein said connector modules have projections matable with recesses in said walls of said connector housing.

* * * * *